US007682190B2

(12) United States Patent
Huang et al.

(10) Patent No.: US 7,682,190 B2
(45) Date of Patent: Mar. 23, 2010

(54) ELECTRICAL CONNECTOR HAVING BOARD LOCK

(75) Inventors: Lin Huang, ShenZhen (CN); Yu-San Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/287,903

(22) Filed: Oct. 14, 2008

(65) Prior Publication Data

US 2009/0098751 A1 Apr. 16, 2009

(30) Foreign Application Priority Data

Oct. 12, 2007 (CN) ..... 2007 2 0043632 U

(51) Int. Cl.
*H01R 13/60* (2006.01)

(52) U.S. Cl. ..... 439/567; 439/571; 439/660

(58) Field of Classification Search ..... 439/567, 439/571, 660
See application file for complete search history.

(56) References Cited

U.S. PATENT DOCUMENTS

| | | | | |
|---|---|---|---|---|
| 5,409,399 | A * | 4/1995 | Geoghegan et al. | 439/567 |
| 5,755,595 | A | 5/1998 | Davis et al. | |
| 6,328,600 | B1 * | 12/2001 | Fujiki et al. | 439/570 |
| 6,406,320 | B1 * | 6/2002 | Wu | 439/358 |
| 6,517,252 | B2 * | 2/2003 | Yamaguchi | 385/53 |
| 6,589,074 | B1 * | 7/2003 | Wu | 439/540.1 |
| 6,679,727 | B1 * | 1/2004 | Yu | 439/567 |
| 6,752,656 | B2 * | 6/2004 | Ho | 439/567 |
| 6,793,541 | B2 * | 9/2004 | Yamaguchi et al. | 439/751 |
| 6,960,089 | B2 * | 11/2005 | Lee et al. | 439/79 |
| 7,052,317 | B2 * | 5/2006 | Hara et al. | 439/567 |
| 7,510,431 | B2 * | 3/2009 | Zhu et al. | 439/567 |
| 2003/0181096 | A1 * | 9/2003 | Chiu | 439/567 |
| 2004/0053529 | A1 * | 3/2004 | Kato et al. | 439/567 |

FOREIGN PATENT DOCUMENTS

| | | |
|---|---|---|
| TW | 588867 | 5/2004 |

* cited by examiner

*Primary Examiner*—Gary F. Paumen
(74) *Attorney, Agent, or Firm*—Wei Te Chung; Andrew C. Cheng; Ming Chieh Chang

(57) ABSTRACT

An electrical connector comprises a dielectric housing, a plurality of conductive contacts respectively secured in the dielectric housing, a first lock and a second lock respectively secured in the dielectric housing. The dielectric housing defines a tongue board defining an engaging face located in a first plane and opposite tongue back face. Each conductive contacts comprising a contacting section extending on the engaging face. The first lock is secured in the first end of the dielectric housing; the second lock is secured in the second end of the dielectric housing. Each of the first and second lock comprises a retaining section secured in the dielectric housing and a holding section extending down beyond the dielectric housing. The first plane intersects the holding section of the second lock, but a center of the holding section of the first lock is apart from the first plane and at the same side of the first plane where the tongue back face located.

12 Claims, 7 Drawing Sheets

ELECTRICAL CONNECTOR HAVING BOARD LOCK

BACKGROUND OF THE INVENTION

1. Field of the Invention

The present invention is generally related to the art of electrical connector for use in a board mounted electrical connector and more particularly to a connector having board lock for securing the connector to a printed circuit board.

2. Description of Related Art

As an interface for data transfer between a host such as a computer and a hard disk drive (HDD) there usually is employed such a protocol as SCSI (Small Computer System Interface) or ATA (Advanced Technology Attachment) Interface. In particular, from the standpoint of improving the interface function and attaining a reduction of cost, the ATA interface is utilized in many computers and is also widely utilized as an interface in other types of storage devices such as optical disk storage devices. With the demand for improving the recording density and improving the performance, the demand for the data transmission rate of the ATA interface is becoming stricter. Therefore, ATA interface using serial transmission instead of the conventional parallel transmission has been proposed.

A standard for SATA (Serial ATA) is being established by "Serial ATA Working Group." A SATA connector is an ATA interface using serial transmission. The board mounted SATA connector in general adapted to be mounted on a printed circuit board for couple with a complementary connector, so retaining strength between the board mounted SATA connector and the printed circuit board will determine the couple times between the complementary connectors.

Hence, an improved electrical connector is required to overcome the disadvantages of the prior art.

SUMMARY OF THE INVENTION

Accordingly, an object of the present invention is to provide a board mounted electrical connector can be well secured on the printed circuit board.

In order to achieve the above-mentioned object, an electrical connector comprises a dielectric housing, a plurality of conductive contacts respectively secured in the dielectric housing, a first lock and a second lock respectively. The dielectric housing defines a first end and an opposite second end, a first surface and an opposite second surface extending between the first and second ends, and a tongue board projecting from the center of the first surface apart from the second surface. The tongue board defines an engaging face located in a first plane and opposite tongue back face. Each conductive contacts comprising a contacting section extending on the engaging face and a mounting section extending beyond the second surface apart from the first surface. The first lock is secured in the first end of the dielectric housing; the second lock is secured in the second end of the dielectric housing. Each of the first and second lock comprises a retaining section secured in the dielectric housing and a holding section extending beyond the second surface along a direction far from the first surface. The first plane intersects the holding section of the second lock, but a center of the holding section of the first lock is apart from the first plane and at the same side of the first plane where the tongue back face located.

Other objects, advantages and novel features of the present invention will become more apparent from the following detailed description of the present embodiment when taken in conjunction with the accompanying drawings.

DETAILED DESCRIPTION OF THE INVENTION

Figure 1:
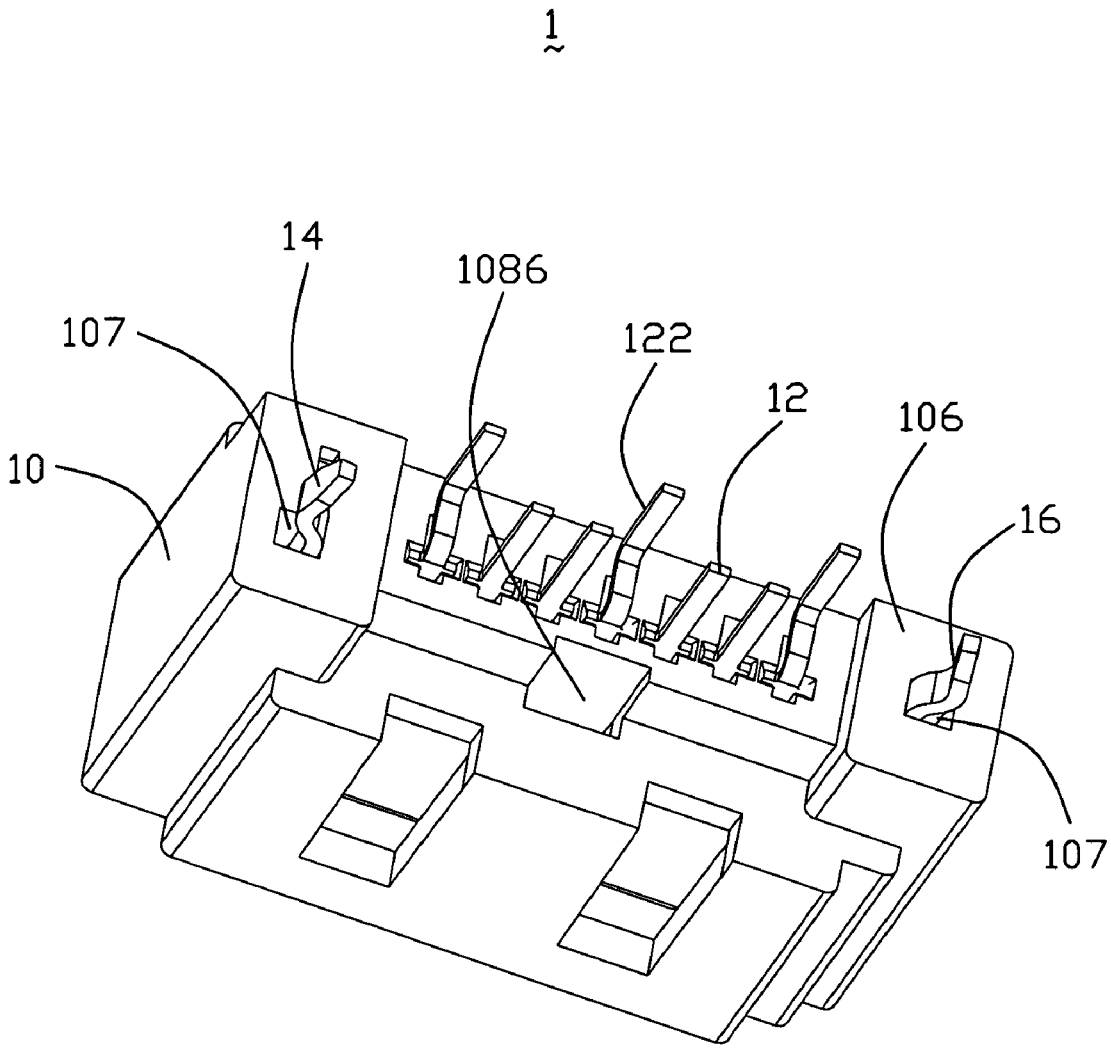
FIG. 1 is an assembled, perspective view of the electrical connector of a preferred first embodiment of the present invention.
Figure 2:
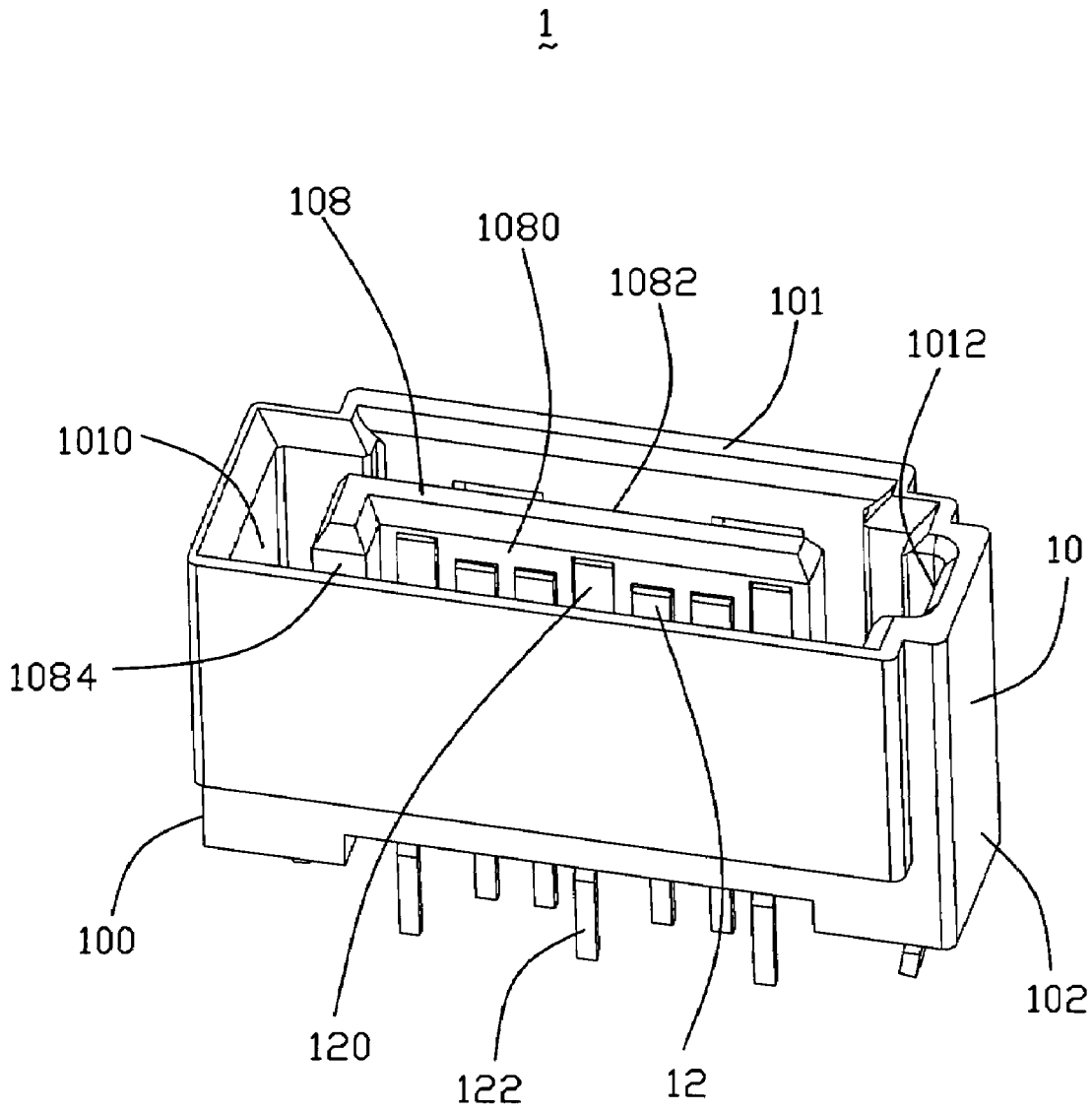
FIG. 2 is an perspective view of the electrical connector as shown in FIG. 1, viewed from another direction.
Figure 3:
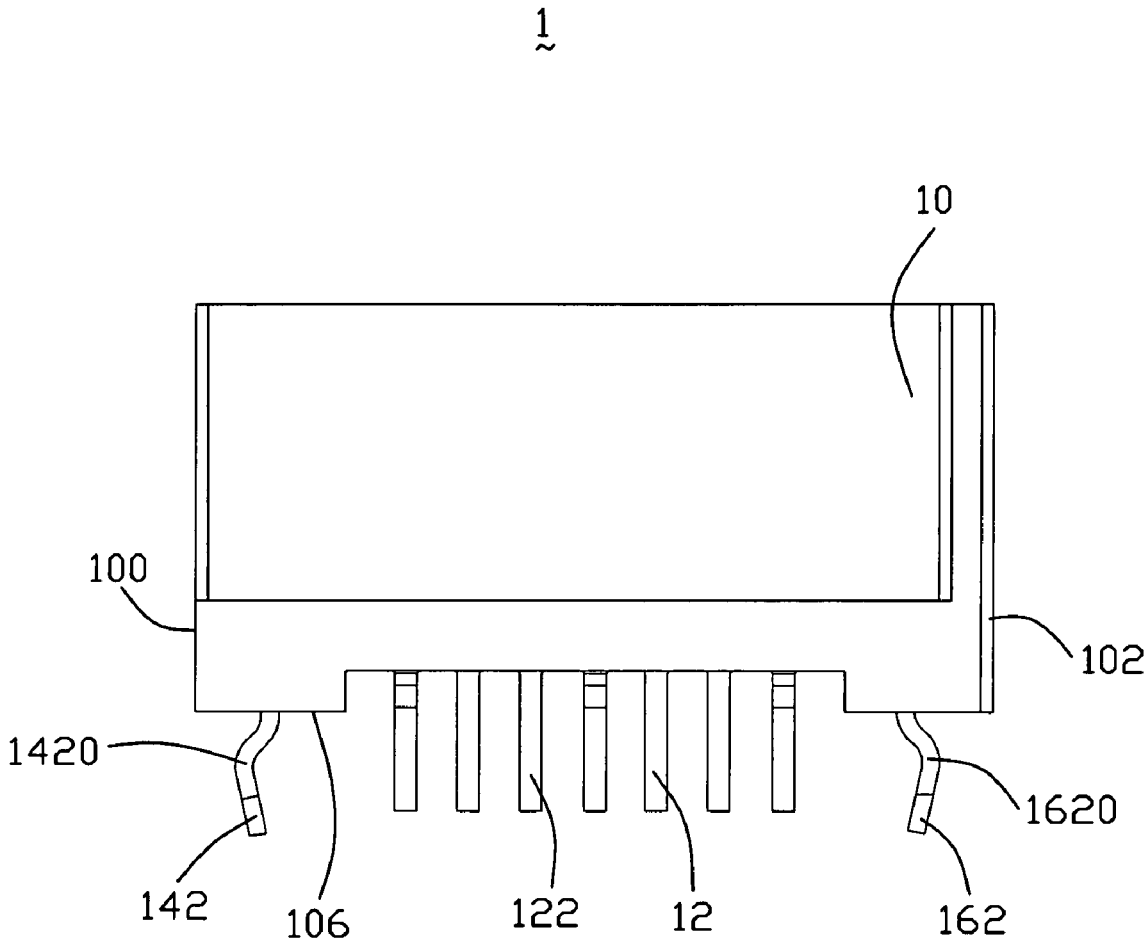
FIG. 3 is a front view of the electrical connector as shown in FIG. 1.

Reference will now be made in detail to the preferred embodiment of the present invention.

Referring to FIGS. 1-5, an electrical connector 1 of a preferred first embodiment of the present invention in general adapted to be mounted on a printed circuit board (not shown) for mating with a complementary connector (not shown), comprises a dielectric housing 10, a plurality of conductive contacts 12 respectively secured in the dielectric housing 10, a first lock 14 and a second lock 16 respectively secured in the dielectric housing 10.

The dielectric housing 10 defines a first end 100 and an opposite second end 102, a first surface 104 and an opposite second surface 106 extending between the first and second ends 102, 104, a tongue board 108 projecting from a center of the first surface 104 apart from the second surface 106, and a bounding wall 101 surrounding and apart from the tongue board 108. The first surface 104 in general adapted to engage a slot in the complementary connector (not shown). The second surface 106 in general adapted to engage the printed circuit board (not shown). The tongue board 108 defines an engaging face 1080, an opposite tongue back face 1082, a key 1084 projecting beyond the engaging face 1080 near an edge of the tongue board 108 next to the first end 100 apart from the tongue back face 1082, and a recess 1086 in the tongue back face 1082. The key 1084 is adapted to prevent wrong direction mating with the complementary connector. The recess 1086 gives a locking feature when mates with a complementary connector (not shown) having a bump corresponding to the recess 1086. The bounding wall 101 comprises a first groove 1010 next to the first end 100 and a second groove 1012 next to the second end 102, the first groove 1010 being wider than the second groove 1012.

Each conductive contacts 12 comprises a contacting section 120 extending on the engaging face 1080 and a mounting section 122 extending beyond the second surface 106 apart from the first surface 104. The contacting sections 120 in general adapted to engage contacts of the complementary connector (not shown) to establish electrical connection therebetween. The mounting sections 122 in general adapted to solder on the printed circuit board (not shown) to establish electrical connection therebetween.

The first lock 14 is secured in the first end 100 of the dielectric housing 10 below the first groove 1010. The second lock 16 is secured in the second end 102 of the dielectric housing 10 below the second groove 1012. Each of the first and second lock 14, 16 comprises a retaining section 140, 160 secured in the dielectric housing 10 and a holding section 142, 162 extending beyond the second surface 106 along a direction apart from the first surface 104. Each holding section 142, 162 of the first and second lock 14, 16 further defining a kink 1420, 1620 having an arch. Wherein, the arches of the two kinks 1420, 1620 are opposite to each other. The distance between the kinks 1420, 1620 of the first and second lock 14, 16 is longer than the distance between the retaining sections 140, 160 of the first and second lock 14, 16. When the electrical connector 1 is placed on the printed circuit board (not shown) for mounting before soldering, the kinks 1420, 1620 can latch in corresponding holes in the printed circuit board (not shown) so the locks 14, 16 hold the electrical connector 1 preventing the electrical connector 1 from moving. The dielectric housing 10 defining a through slot 107 corresponding to each the kink 1420, 1620 having a size larger than the corresponding kink 1420, 1620, so the kinks 14520, 1620 can pass through the through slot 107.

Figure 6:
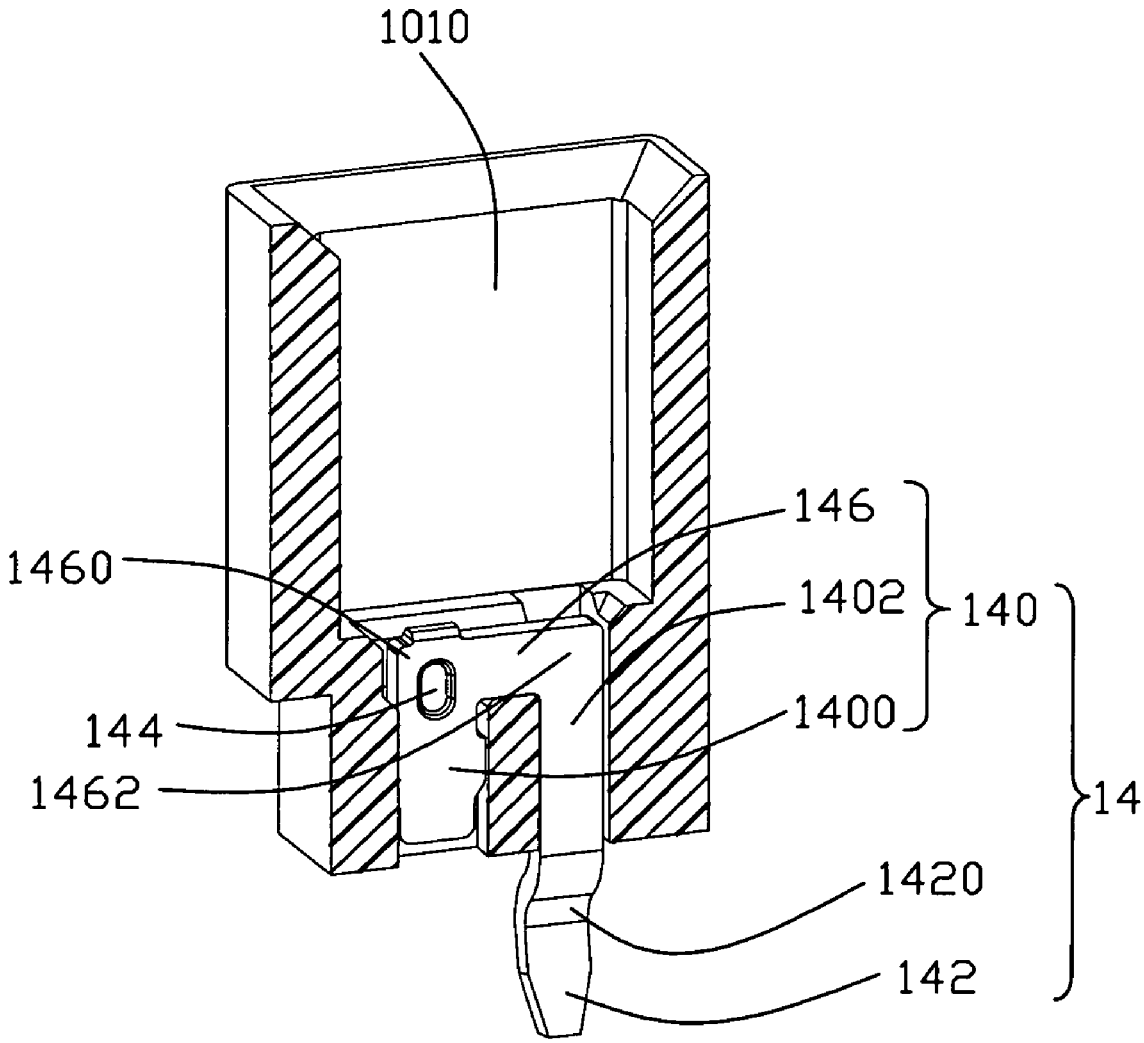
FIG. 6 is a cross-sectional view taken along lines 6-6 of FIG. 4.

Referring to FIG. 6 in conjunction, the retaining section 140 of the first lock 14 comprises a transverse base section 146 near the first surface 104 comprising a first edge 1460 and an opposite second edge 1462, a first retaining section 1400 extending down from the first edge 1460 toward the second surface 106, a second retaining section 1402 extending down from the second edge 1462 toward the second surface 106. The holding section 142 extends down from the lower edge of the second retaining section 1402. The dielectric housing 10 further defines a rib (not labeled) extending between the first and second retaining section.

Figure 7:
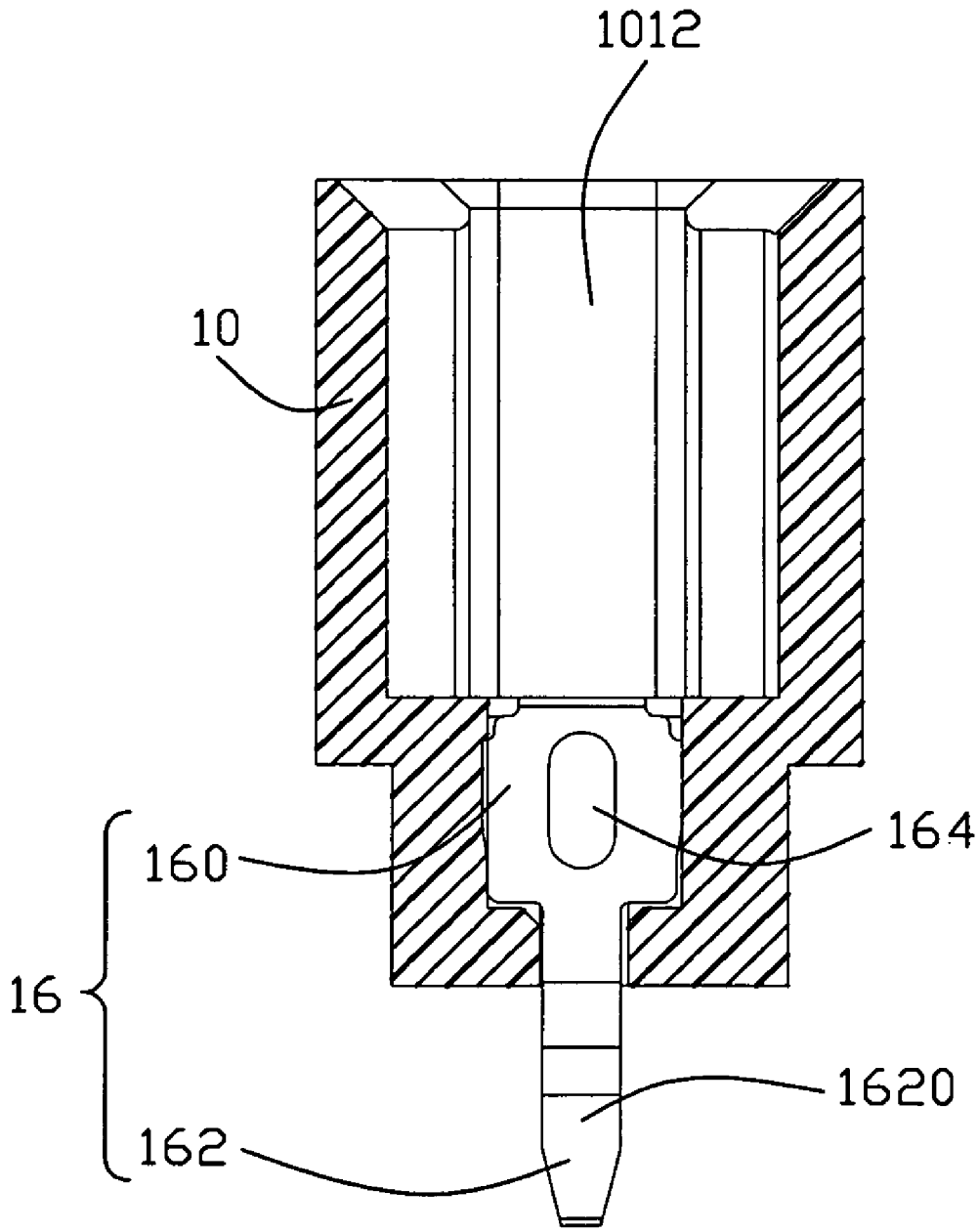
FIG. 7 is a cross-sectional view taken along lines 7-7 of FIG. 4.

Referring to FIG. 7 in conjunction, the first lock 14 and second lock 16 being sheet metal working products each having a stamped dimple 144, 164 on the retaining section 140, 160. The dimple 144 of the first lock 14 is on the area where the base section 146 and the first retaining section 1400 joined, and the dimple 164 of the second lock 16 is on a center area of the retaining section 160. These dimples 144, 164 interfere with the dielectric housing 10 when the locks 14, 16 being inserted therein, so the locks 14, 16 are steadily secured in the dielectric housing 10.

Figure 4:
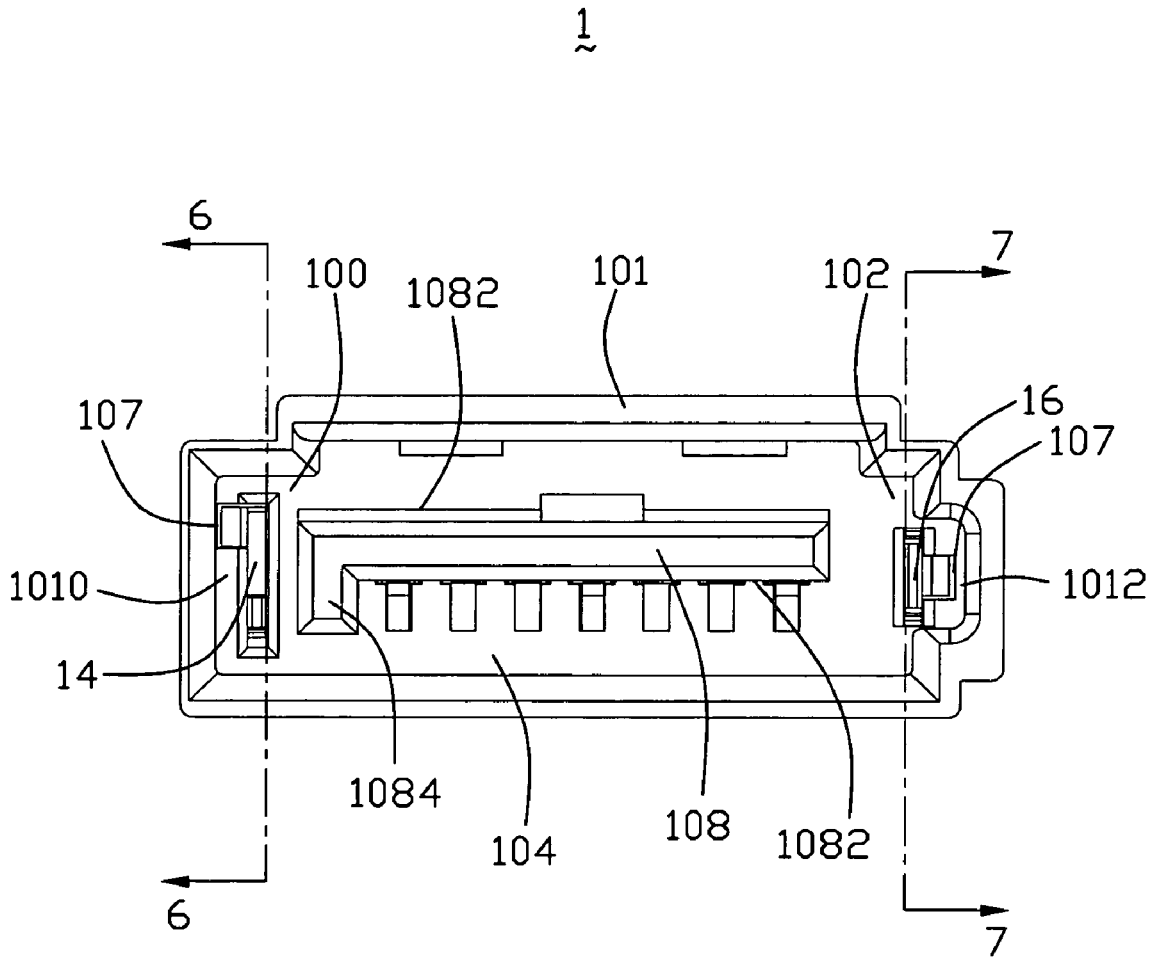
FIG. 4 is a top view of the electrical connector as shown in FIG. 1.
Figure 5:
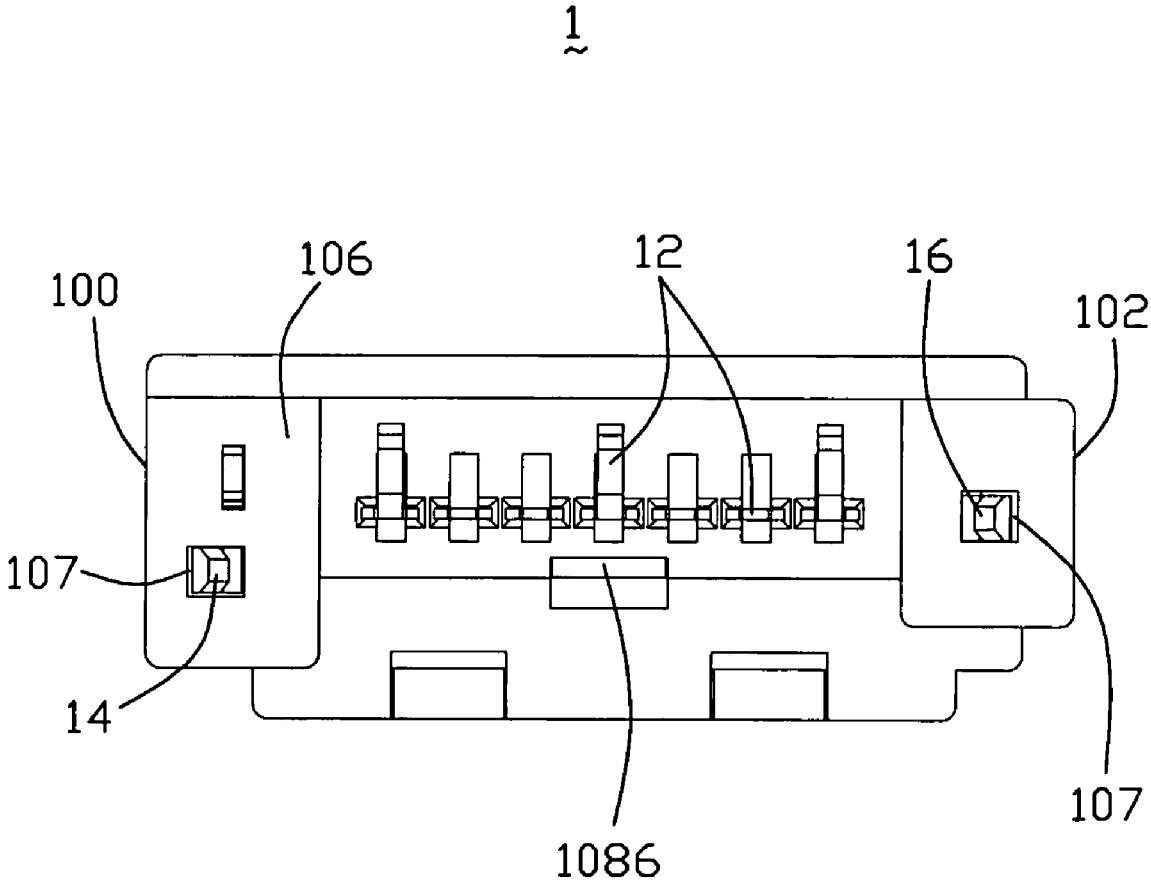
FIG. 5 is a bottom view of the electrical connector as shown in FIG. 1.

Specially referring to FIGS. 4 and 5, a plane (not shown) where the engaging face 1080 of the tongue board 108 is located intersects the holding section 162 of the second lock 16 across a center thereof, but does not intersect the holding section 142 of the first lock 14. A center of the holding section 142 of the first lock 14 is apart from the plane (not shown) where the engaging face 1080 is located at the same side where the tongue back face 1082 is located, so the holding strength is good balanced. When a complementary connector (not shown) being plugged in or being withdraw, the electrical connector 1 can do its best to resist shaking.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

a dielectric housing defining a first end and an opposite second end, a first surface and an opposite second surface extending between said first and second ends, a tongue board projecting from the center of said first surface apart from said second surface, said tongue board defining an engaging face and an opposite tongue back face;

a plurality of conductive contacts respectively secured in said dielectric housing, each conductive contacts comprising a contacting section extending on the engaging face and a mounting section extending beyond said second surface apart from said first surface;

a first lock secured in said first end of the dielectric housing; and a second lock secured in said second end of the dielectric housing;

each of said first and second lock comprising a retaining section secured in said dielectric housing, a holding section extending beyond said second surface from an end of the retaining section; wherein the retaining section is an inverted U-shape, the retaining section defines a cambered kink, each kink has an arch, the arches of the two kinks are opposite to each other.

2. The electrical connector as described in claim 1, wherein the retaining section of said first lock comprises a transverse base section near said first surface, said base section comprises a first edge and an opposite second edge, a first retaining section extends downwardly from said first edge toward said second surface, a second retaining section extends downwardly from said second edge toward said second surface, a rib defined in said dielectric housing extends between said first and second retaining section, said holding section extends downwardly from the lower edge of said second retaining section.

3. The electrical connector as described in claim 2, wherein said tongue board further defines a key projecting beyond said engaging face near an edge of said tongue board next to said first end apart from said tongue back face.

4. The electrical connector as described in claim 1, wherein said dielectric housing further comprises a bounding wall surrounding and apart from said tongue board, said bounding wall comprises a first groove next to said first end and a second groove next to said second end, said first groove is wider than said second groove, said first lock locates below said first groove, said second lock locates below said second groove.

5. The electrical connector as described in claim 1, wherein the distance between said kinks of said first and second lock is longer than the distance between said retaining sections of said first and second lock, said dielectric housing defines a through slot corresponding to each said kink having a size larger than the corresponding kink.

6. The electrical connector as described in claim 2, wherein each first lock and second lock has a stamped dimple on said retaining section.

7. The electrical connector as described in claim 6, wherein said dimple of said first lock locates on the area where said base section and the first retaining section joined, said dimple of said second lock locates on center area of said retaining section.

8. An electrical connector for mounting to a printed circuit board, comprising:

an insulative housing defining a receiving cavity which extends through a front mating face of the housing and is asymmetrical with regard to both a longitudinal center line and a vertical center line of the housing perpendicular to said longitudinal center line;

a downward lying L-shaped mating section formed in the receiving cavity, one end of a horizontal segment of the mating section joined with a vertical segment confronting a first lengthwise end region of the receiving cavity, which is essentially of a full rectangular structure while the other end of the horizontal segment confronts a second lengthwise end region of the receiving cavity, which includes a pair of stepped structures at two outermost corners; and first and second board locks respectively disposed in the corresponding first and second end regions, each of said first and second board locks defining a mounting leg for mounting to said printed circuit board; wherein the L-shaped mating section defines opposite outer surface and inner surface on the horizontal segment parallel to said longitudinal center line, under a condition that the mounting leg of the first board lock is asymmetrically located in the first end region with regard to a center axis parallel to the longitudinal center line; wherein the first board lock is structurally different from the second board lock while both of said first board lock and said second board lock are downwardly assembled into the housing from said front mating face.

9. The electrical connector as claimed in claim 8, wherein the mounting leg of said first board lock is located closer to the outer surface than to the inner surface.

10. The electrical connector as claimed in claim 8, wherein the mounting leg of said second board lock is symmetrically located in the second end region.

11. The electrical connector as claimed in claim 8, wherein the mounting leg of the first board lock is curved, said first board lock is assembled to the housing from the front mating face, and said housing defines a passage to allow the curved mounting leg to pass during assembling.

12. An electrical connector for mounting to a printed circuit board, comprising:

an insulative housing defining a receiving cavity which extends though a front mating face of the housing and is asymmetrical with regard to both a longitudinal center line and a vertical center line of the housing perpendicular to said longitudinal center line;

a downward lying L-shaped mating section formed in the receiving cavity, one end of a horizontal segment of the mating section joined with a vertical segment confronting a first lengthwise end region of the receiving cavity, which is essentially of a full rectangular structure while the other end of the horizontal segment confronts a second lengthwise end region of the receiving cavity, which includes a pair of stepped structures at two outermost corners; and first and second board locks respectively disposed in the corresponding first and second end regions, each of said first and second board lock defining a mounting leg for mounting to the printed circuit board; wherein the L-shaped mating section defines opposite outer surface and inner surface on the horizontal segment parallel to said longitudinal center line, under a condition that the mounting leg of the first board lock is asymmetrically located in the first end region with regard to a center axis parallel to the longitudinal center line; wherein the mounting leg of the first board lock is curved, said first board lock is assembled to the housing from the front mating face, and said housing defines a passage to allow the curved mounting leg to pass during assembling.

* * * * *